United States Patent [19]

Jennings

[11] Patent Number: 4,871,282

[45] Date of Patent: Oct. 3, 1989

[54] TENSION LEG PLATFORM TENDON TOP CONNECTOR

[75] Inventor: Charles E. Jennings, Houston, Tex.

[73] Assignee: Vetco Gray Inc., Houston, Tex.

[21] Appl. No.: 139,671

[22] Filed: Dec. 30, 1987

[51] Int. Cl.[4] ..... E02B 17/06; B63B 35/44; F16L 19/07; F16B 37/08

[52] U.S. Cl. ..... 405/224; 405/203; 405/227; 114/265; 285/39; 285/141; 285/145; 403/369; 403/374; 411/433

[58] Field of Search ..... 405/195, 224, 203, 227; 403/104, 110, 374, 369; 411/433, 434; 166/75.1, 85; 285/39, 138–141, 145, 394, 144; 114/264, 265

[56] References Cited

U.S. PATENT DOCUMENTS

| | | | |
|---|---|---|---|
| 1,469,894 | 10/1923 | Clarke | 285/145 X |
| 2,410,589 | 11/1946 | Segelhorst | 285/145 |
| 2,489,613 | 11/1949 | Beswick . | |
| 2,587,192 | 2/1952 | Meyer | 285/139 X |
| 2,689,139 | 9/1954 | Jones et al. | 285/146 |
| 2,705,605 | 4/1955 | Kreissig et al. | 403/104 X |
| 2,789,458 | 4/1957 | Skeisvoll | 411/433 |
| 2,897,895 | 8/1959 | Ortloff | 285/145 X |
| 2,974,557 | 3/1961 | Akutowicz | 411/434 |
| 3,058,386 | 10/1962 | Morrow | 403/369 X |
| 3,436,084 | 4/1969 | Courter | 285/139 X |
| 3,664,689 | 5/1972 | Hanes | 285/141 X |
| 3,957,381 | 5/1976 | Schafer | 403/369 X |
| 4,234,151 | 11/1980 | John et al. | 403/369 X |
| 4,329,088 | 5/1982 | Lucas | 405/196 |
| 4,332,169 | 6/1982 | Stuart | 73/487 |

FOREIGN PATENT DOCUMENTS

| | | | |
|---|---|---|---|
| 308236 | 8/1971 | U.S.S.R. | 411/433 |

OTHER PUBLICATIONS

Glenn M. Wald and H. Steven Owens, "An Integrated Approach to TLP Tendon System Component Design" Apr. 1987.

*Primary Examiner*—Randolph A. Reese
*Assistant Examiner*—John A. Ricci
*Attorney, Agent, or Firm*—James E. Bradley

[57] ABSTRACT

A tension leg floating platform for offshore drilling has a plurality of tendons extending from the sea floor to the platform in tension. The upper connector for each tendon includes a housing with a conical shoulder located therein. A terminal segment on the upper end of each tendon extends through the housing. Dogs are carried on the shoulder of the housing, each having threads on the interior for mating threads formed on the terminal segment. A cam ring moves the dogs from an outer retracted position to an inner engaged position. The cam ring also will rotate the dogs relative to the terminal to mesh the threads of the dogs with the threads of the terminal segment.

6 Claims, 3 Drawing Sheets

TENSION LEG PLATFORM TENDON TOP CONNECTOR

BACKGROUND OF THE INVENTION

1. Field of the Invention

This invention relates in general to tension leg platforms for offshore drilling, and in particular to a top connector for connecting the upper end of a tendon to the platform.

2. Description of the Prior Art

A tension leg platform is a type of offshore drilling and production structure. The platform floats and is secured to the sea floor by tendons. The tendons are large pipes, about twenty inches in diameter. After securing the tendons to the platform and to the sea floor, ballast water is pumped out to cause the platform to rise. This is resisted by the tendons, placing the tendons under high tension load. The tendons under tension provide a stable platform for drilling and oil production.

In the prior art, the upper end of the tendon extends through a hawse pipe and is connected at the top above the platform. A terminal segment containing helical threads is secured to the upper end of the tendon. A nut is rotated onto the terminal segment to secure the upper connection.

A disadvantage of this type of connection is that the columns or hawse pipes must be designed to prevent buckling because the tension load will be reacted through the hawse pipe from the top. Locating the top connector at the bottom of the column would improve platform stability and avoid reacting the tension load through the column. However, because the connection will be located below the surface of the water, access to install the connection will be more difficult. Proposals have been made for top connectors to be installed below the surface of the water, but improvements are desirable.

SUMMARY OF THE INVENTION

The top connector of this invention is located at the bottom of a column of a tension leg platform. It is located below the surface of the water. A terminal segment on the upper end of each tendon extends through a housing. The housing has a bore with a conical shoulder located therein. A number of dogs are carried in the housing on the conical shoulder. The dogs can move from a retracted position downward to an engaged position engaging the helical threads on the terminal segment.

A cam ring is rotatable relative to the dogs to move the dogs between the retracted and engaged positions. The cam ring also is used to rotate the dogs after they are in the engaged position to mesh the threads of the dogs with the threads of the terminal segment.

A locking device is placed on top of the dogs after the dogs are in the engaged position. The locking device has a number of locking segments that engage the threads. These locking segments are carried in a locking cage. A wedge ring wedges the locking segments in place, securing them to the terminal segment.

DESCRIPTION OF THE PREFERRED EMBODIMENT

Figure 1:
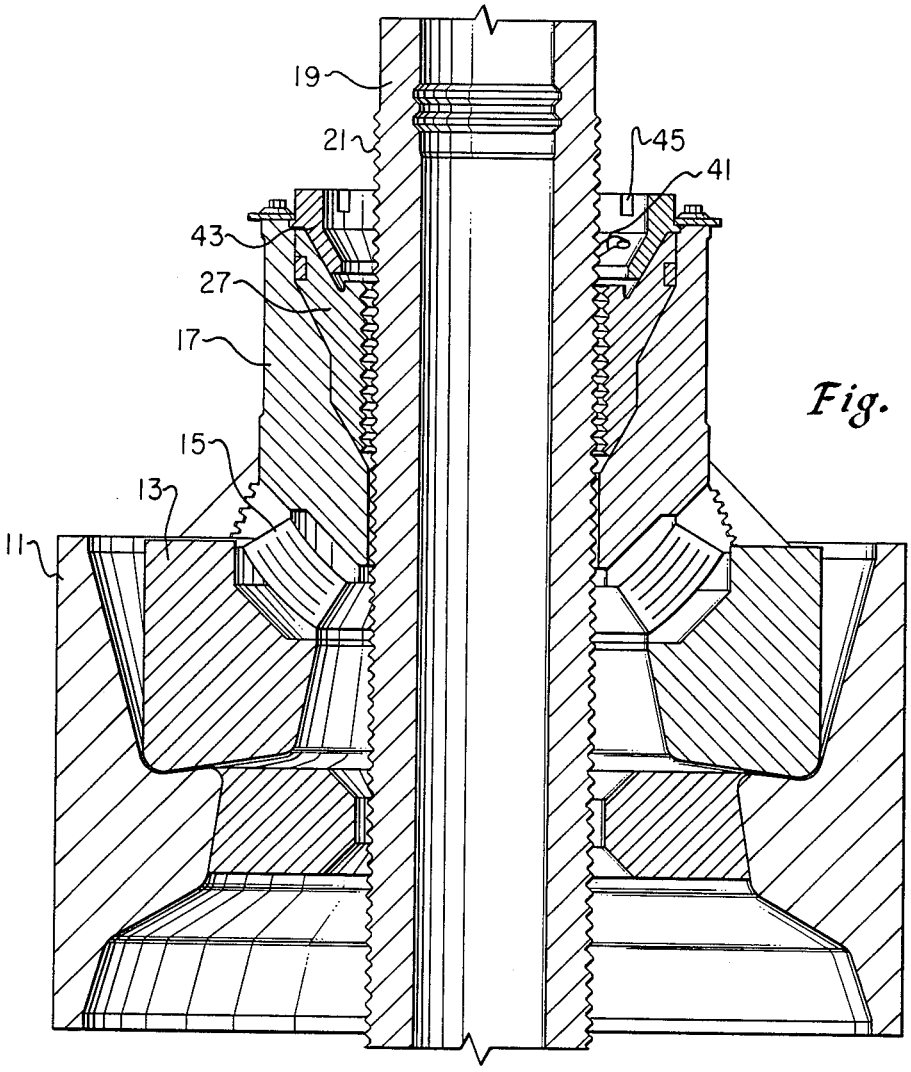
FIG. 1 is a vertical sectional view of a top connector for a tension leg platform constructed in accordance with this invention.

Referring to FIG. 1, a receptacle 11 will be mounted to the tension leg platform (not shown) at a bottom of a column. Receptacle 11 will be submerged. Receptacle 11 has a seat within it which supports a base 13. Flex elements 15 are mounted to the base 13. The flex elements 15 are a combination of elastomer and metal plates. A housing 17 is secured to the flex elements 15. The flex elements 15 allow the housing 17 to move longitudinally and laterally with wave movement.

A terminal segment 19 extends upward through housing 17. Terminal segment 19 is a tubular member secured to the upper end of a tendon (not shown). The terminal segment 19 contains exterior helical threads 21.

Figure 2:
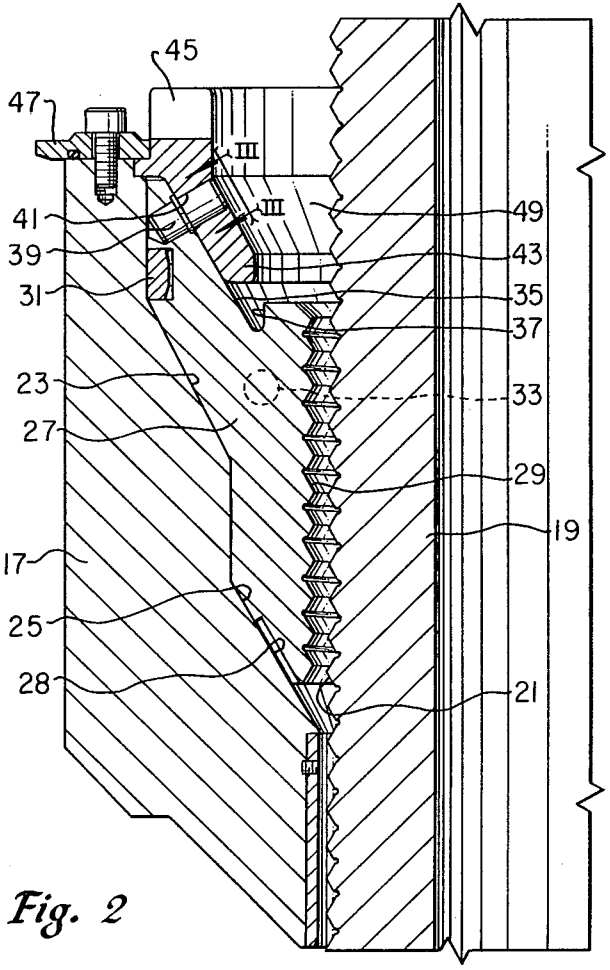
FIG. 2 is a partial sectional view of a top connector of FIG. 1, showing the dogs in a retracted position.

Referring to FIG. 2, the housing 17 has two frusto-conical shoulders 23, 25. The shoulders 23, 25 incline downward, each preferably at an angle in the range from about 25 to 35 degrees measured from the vertical axis of the housing 17. The shoulders 23, 25 are separated by a cylindrical portion in the bore of housing 17.

Four separate dogs 27 are carried on the shoulders 23, 25. Each dog 27 has conical surfaces that slidingly mate with the shoulders 23, 25. A relief groove 28 is formed on the lower side of each dog 27 near the lower end. Each dog 27 has internal threads 29 that are formed to mate with the threads 21 on the terminal segment 19. The dogs 27 will slide between an upper retracted position, shown in FIG. 2, to a lower engaged position, shown in FIGS. 4 and 5.

A split retaining ring 31 encircles the dogs 27 and retains them together as they slide downward from the retracted position to the engaged position. Locking pins 33 extend slidingly between the side surfaces or edges of the dogs 27 to assure that the dogs 27 maintain alignment with each other as they slide upward and downward. Because the shoulders 23, 25 of the housing 17 are conical, the dogs 27 will be spaced farther apart from each other when in the retracted position than when in the engaged position.

Each dog 27 has on its upper side a frusto-conical surface 35. The conical surface 35 is at the same inclination as the shoulders 23, 25 of housing 17. An outward facing shoulder or rim 37 is located at the bottom of the conical surface 35. A guide pin 39 extends upward from each dog 27. Each guide pin 39 is perpendicular to the conical surface 35.

Figure 3:
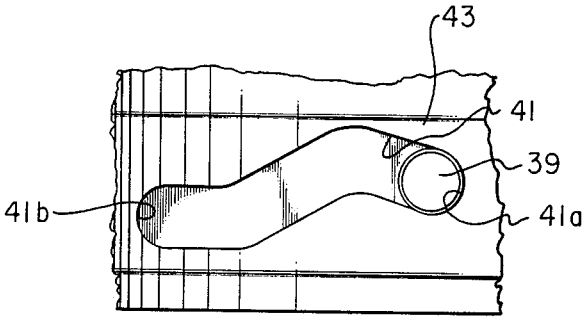
FIG. 3 is a view of part of the cam ring of the locking cohnector, shown along the line III—III of FIG. 2.

Referring to FIG. 3, each guide pin 39 locates within a guide slot 41. The guide slot 41 is formed in a cam ring 43. The guide slot 41 extends circumferentially a selected distance. It has an upper end **41*a* and a lower end 41*b*. The upper end 41*a* is higher than the lower end 41*b*, but a section of the guide slot 41 between the ends 41*a*, 41*b* extends even higher than the upper end 41*a***.

Referring to FIG. 2, cam ring 43 is a solid ring that has a lower conical surface that mates slidingly with the conical surface 35 of each dog 27. A recess or slot 45 is formed in the upper edge of the cam ring 43 to enable a wrench (not shown) to be placed therein to rotate the cam ring 43. A retaining ring 47 maintains the cam ring 43 on the housing 17, but allows rotation of the cam ring 43 relative to the housing.

A hole (not shown) will be located in at least one of the dogs 27 for receiving a part or prong of the above-mentioned wrench (not shown). Another prong of the wrench engages the slot 45. The wrench is articulated so that the prongs can move relative to each other. The wrench will rotate the cam ring 43 relative to the dogs 27 until the guide slot 41 moves to a position where the guide pin 39 is at the lower end **41*b*. Continued rotation of the cam ring 43 then rotates all of the dogs 27 in unison with the cam ring 43. Because the end 41*b* is lower than end 41*a* of the guide slot 41, the dogs 27 will slide down on the shoulders 23, 25 when the cam ring 43 is rotated relative to the dogs 27**.

Figure 5:
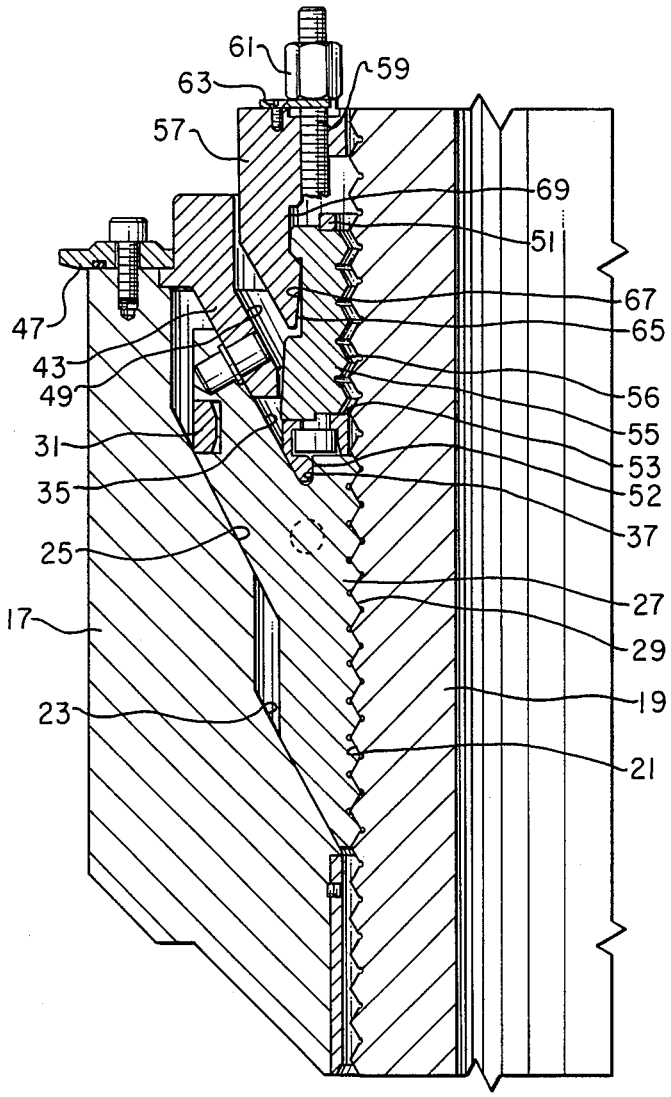
FIG. 5 is a partial vertical sectional view of the top connector of FIG. 1, showing the locking device in a released position.

Referring to FIG. 5, a locking means is shown for locking the dogs 27 in the engaged position. The cam ring 43 has a conical upper surface 49, and the locking mean locates between this surface and the terminal segment 19. The locking means includes a cylindrical locking cage 51. The locking cage 51 has a depending shoulder 52 that locates outward and in contact with the rim 37 of the dogs 27. The locking cage 51 has a number of apertures 53 spaced around its circumference. A dog or locking segment 55 is reciprocally carried in each aperture 53. Each segment 55 has a segment of threads 56 on its inner face for engaging the threads 21 of the terminal segment 19.

A solid wedge ring 57 locates outward of each locking segment 55. The wedge ring 57 is movable between an upper position shown in FIG. 5 and a lower locked position shown in FIG. 4. The wedge ring 57 is secured to the locking cage 51 by a number of bolts 59 and nuts 61 (only one shown). A plate 63 is secured to the upper end of the wedge ring 57 and rotatably connected with the nuts 61. Plate 63 causes the wedge ring 57 to move upward as the nuts 61 are unscrewed.

The wedge ring 57 has a tapered surface 65 on its lower end that mates slidingly with the outer side of each locking segment 55. The taper is about four degrees relative to the vertical axis of the housing 17. In the upper position, the tapered surface 65 locates within a recess 67 formed on the outer side of each locking segment 55. A recess 69 is also formed on the inner side of the wedge ring 57 for receiving a portion of each locking segment 55 located above the recess 67. In the lower position, the tapered surface 65 of the wedge ring 57 will engage the tapered surface on the locking segments 55 to push them inward into engagement with the terminal segment threads 21.

In operation, a crane (not shown) will hold the terminal segment 19 while the base 13, housing 17 and related equipment are lowered into place in the position shown in FIG. 1. Water in buoyancy tanks on the platform will locate the housing 17 at the approximate proper point relative to the terminal segment 19.

Then, a diver will rotate the cam ring 43 relative to the dogs 27. He will use a tool or wrench that locates in the slot 45 (FIG. 2) and in a hole located within at least one of the dogs 27 so as to allow this relative rotation. As he rotates the cam ring 43, the dogs 27 will slide downward. When the guide pin 39 contacts the lower end **41*b* of the guide slot 41 (FIG. 3), the dogs 27 will have slipped down into contact with the terminal segment 19**.

It is likely that the threads 29 of the dogs 27 will not mesh with the threads 21 of the terminal segment 19 at that point because precise alignment would have been difficult to achieve. The diver thus continues to rotate the cam ring 43. Now, the dogs 27 will rotate in unison with the cam ring 43. Because of the inclination of the threads 21 of the terminal segment 19, after less than one turn, the threads 21 and 29 will mesh. The dogs 27 will then be contacting each other along their side surfaces and located in the position shown in FIGS. 4 and 5.

Figure 4:
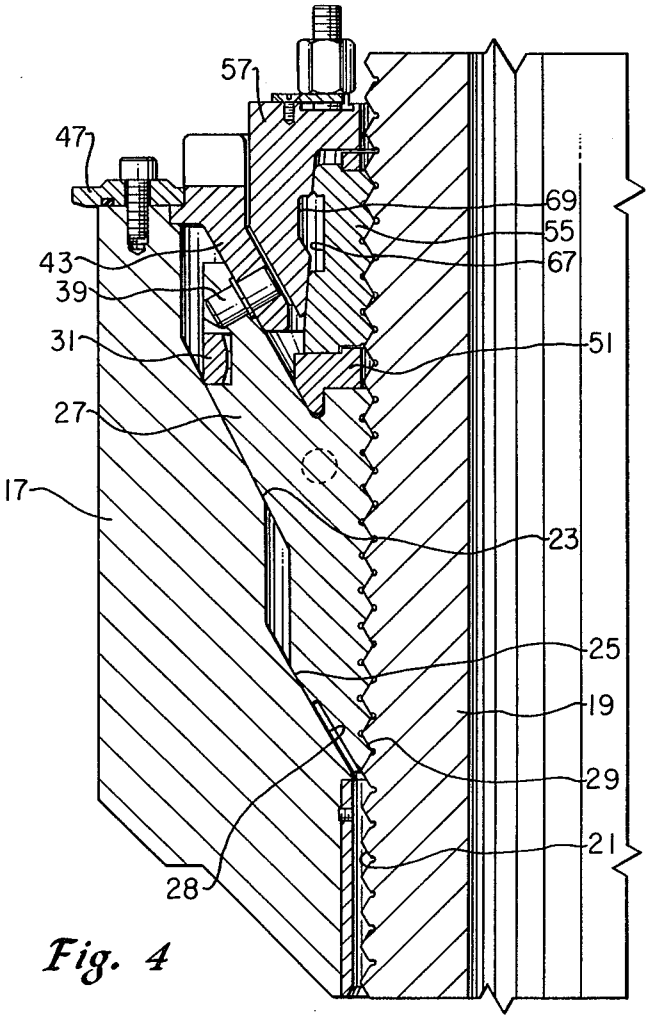
FIG. 4 is a partial sectional view of the locking connector of FIG. 1, showing the dogs in an engaged position and, showing the locking device in a locked position.

Then the locking assembly can be installed. It is placed on top of the dogs 27 and cam ring 43 as shown in FIG. 5. Initially the locking segments 55 will be retracted and the wedge ring 69 will be in an upper position as shown in FIG. 5. The nuts 61 are rotated to push the wedge ring 57 downward. The tapered surface 65 will engage the tapered surface on the locking segments 55, pushing them inward. The threads 56 will engage the threads 21 of the terminal segment 19. When fully moved down, the wedge ring 57 will be as shown in FIG. 4, with its lower tapered surface overlying the upper conical surface 49 of the cam ring 43. The shoulder 52 of the locking cage 51 bears against the rim 37.

Water can then be pumped out of buoyancy tanks on the platform to apply the desired amount of tension in the tendons. Referring to FIG. 1, the load path of the tension will pass from the terminal segment 19 through the dogs 27, to the housing 17, through the flex elements 15 and base 13 to the receptacle 11, which is supported by a column of the platform. Should wave action of the sea result in the housing 17 moving downward from the dogs 27, the dogs 27 will still remain in engagement with the terminal segment threads 21. The shoulder 52 of the locking cage 51 will prevent the dogs 27 from moving outward. The wedge ring 57 will maintain the locking segments 55 locked to the terminal segment 19 at all times.

The connector may be released by rotating the nuts 61 in the opposite direction to retract the wedge ring 57. The locking assembly can then be pulled upward. Then the cam ring 43 can then be rotated in the reverse direction to locate the guide pin 39 at the upper end **41*a* of the guide slot (FIG. 3). The dogs 27 are then free to move upward on the shoulders 23, 25**.

The invention has significant advantages. The top connector can be installed below the surface of the water by a diver. The rotation required will be less than one turn. The dogs can be positively locked to avoid disconnection during surging of the sea.

While the invention has been shown in only one of its forms, it should be apparent to those skilled in the art that it is not so limited, but is susceptible to various changes without departing from the scope of the invention.

I claim:

1. In a floating platform having a plurality of tendons extending in tension from the sea floor to the platform, an improved means for connecting the upper end of each tendon to the platform, comprising in combination:

a housing supported by the platform and having a bore with a conical shoulder formed therein;

a terminal segment on the upper end of each tendon, having external grooves and extending through the bore of the housing;

a plurality of dogs carried on the shoulder in the housing, each having an inner face containing grooves for mating with the grooves of the terminal segment, each dog having an inclined surface;

a cam ring mounted rotatably to the housing above the dogs, the cam ring having an inclined surface that mates with the inclined surface of each of the dogs; and means, including an inclined guide slot located in one of the inclined surfaces and a pin protruding from the other of the inclined surfaces and engaging the guide slot, for causing each dog to slide down the conical shoulder into contact with the grooves of the tendon when the cam ring is rotated in one direction relative to the dogs, and for causing each dog to slide upward on the conical shoulder and disengage from the grooves of the tendon when the cam ring is rotated in the other direction relative to the dogs.

2. In a floating platform having a plurality of tendons extending in tension from the sea floor to the platform, an improved means for connecting the upper end of each tendon to the platform, comprising in combination:

a housing supported by the platform and having a bore with a conical shoulder formed therein;

a terminal segment on the upper end of each tendon, having external helical threads and extending through the bore of the housing;

a plurality of dogs carried on the shoulder in the housing, each having an inner face containing helical threads for mating with the threads of the terminal segment, each dog having an inclined surface on its upper end that is at substantially the same inclination as the conical shoulder;

a cam ring mounted rotatably to the housing above the dogs, the cam ring having an inclined surface on its lower side that mates with the inclined surface of each of the dogs;

a guide slot located in one of the inclined surfaces and having an upper end being located a selected distance lower and rotationally from a lower end;

a pin protruding from the other of the inclined surfaces and engaging the guide slot, the pin being positionable in the guide slot between an upper position at the upper end of the guide slot and a lower position at the lower end of the guide slot;

the cam ring being rotatable relative to the dogs a selected amount for causing each dog to slide down the conical shoulder into contact with the threads of the tendon when the guide slot and pin are moved relative to each other from the upper position to the lower position; and the dogs being rotatable in unison with the cam ring relative to the tendon by continued rotation of the cam ring after the pin is in the lower position, to mesh the threads of the dogs with the threads of the tendon.

3. In a floating platform having a plurality of tendons extending in tension from the sea floor to the platform, an improved means for connecting the upper end of each tendon to the platform, comprising in combination:

a housing supported by the platform and having a bore with a conical shoulder formed therein;

a terminal segment on the upper end of each tendon, having external grooves and extending through the bore of the housing;

a plurality of dogs carried on the conical shoulder in the housing, each having an inner face containing grooves for mating with the grooves of the terminal segment;

means for sliding the dogs on the conical shoulder from an upper position spaced outward from the grooves of the terminal segment to the lower position engaging the grooves of the terminal segment; and locking means secured to the terminal segment on top of the dogs when the dogs are in the lower position for preventing the dogs from sliding upward on the conical shoulder, the locking means including a locking element having inner grooves which engage the grooves of the terminal segment.

4. In a floating platform having a plurality of tendons extending in tension from the sea floor to the platform, an improved means for connecting the upper end of each tendon to the platform, comprising in combination:

a housing supported by the platform and having a bore with a conical shoulder formed therein;

a terminal segment on the upper end of each tendon, having external grooves and extending through the bore of the housing;

a plurality of dogs carried on the conical shoulder in the housing, each having an inner face containing helical grooves for mating with the grooves of the terminal segment;

means for sliding the dogs on the conical shoulder from an upper position spaced outward from the grooves of the terminal segment to a lower position engaging the grooves of the terminal segment;

a locking cage positionable on top of the dogs when the dogs are in the lower position, the locking cage having a plurality of apertures;

a locking segment located in each aperture of the cage and having an inner face containing a plurality of grooves for engaging the grooves of the tendon; and wedge means for moving each locking segment inward relative to the cage into engagement with the grooves of the tendon and for securing the cage to the tendon to prevent the dogs from sliding upward on the conical shoulder.

5. In a floating platform having a plurality of tendons extending in tension from the sea floor to the platform, an improved means for connecting the upper end of each tendon to the platform, comprising in combination:

a housing supported by the platform and having a bore with a conical shoulder formed therein;

a terminal segment on the upper end of each tendon, having external helical threads and extending through the bore of the housing;

a plurality of dogs carried on the shoulder in the housing, each having an inner face containing helical threads for mating wire the threads of the terminal segment, each dog having an inclined surface on its upper end that is at substantially the same inclination as the conical shoulder;

a cam ring mounted rotatably to the housing above the dogs, the cam ring having an inclined surface on its lower side that males with the inclined surface of each of the dogs;

a guide slot located in one of the inclined surfaces and having an upper end being located a selected distance lower and rotationally from a lower end;

a pin protruding from the other of the inclined surfaces and engaging the guide slot, the pin being positionable in the guide slot between an upper position at the upper end of the guide slot and a lower position at the lower end of the guide slot;

the cam ring being rotatable relative to the dogs a selected amount for causing each dog to slide down the conical shoulder into contact with the threads of the tendon when the side lot and pin are moved relative to each other from the upper position to the lower position; and the dogs being rotatable in unison with the cam ring relative to the housing by continued rotation of the cam ring after the pin is in the lower position, to mesh the threads of the dogs with the threads of the tendon;

an outward facing shoulder located on each dog at the base of the inclined surface of the dog;

a locking cage positionable on top of the dogs and the cam ring when the dogs are in the lower position, the locking cage having a plurality of apertures, the locking cage having in inward facing flange that engages the shoulder of each dog;

a locking segment located in each aperture of the cage and having an inner face containing a plurality of grooves for engaging the grooves of the tendon; and wedge means for moving each locking segment inward relative to the cage into engagement with the grooves of the tendon and for securing the cage to the tendon to prevent the dogs from sliding upward on the conical shoulder.

6. A method for making an upper connection between a floating platform and a tendon extending in tension from the sea floor to the platform, comprising in combination:

mounting a housing to the platform and providing the housing with a bore having a conical shoulder formed therein;

securing a terminal segment having external grooves to the upper end of the tendon, and extending the terminal segment through the bore of the housing;

placing a plurality of dogs on the shoulder in the housing, each dog having an inner face containing grooves for mating with the grooves of the terminal segment;

while pulling upward on the terminal segment, sliding the dogs downward on the conical shoulder from an outer position spaced outward from the grooves of the terminal segment to an inner position contacting the grooves of the terminal segment;

providing a locking member having a locking element containing inner grooves: and securing the locking member to the terminal segment on top of the dogs with the grooves of the locking element engaging the grooves of the terminal segment to prevent the dogs from sliding upward on the conical shoulder.

* * * * *